United States Patent [19]

Dammeyer

[11] 4,047,593

[45] Sept. 13, 1977

[54] ACTUATING SYSTEM FOR TRANSPORTABLE ARTICULATED BOOMS HAVING RAISABLE PLATFORMS

[75] Inventor: Bruce Dammeyer, Fort Wayne, Ind.

[73] Assignee: Teco, Inc., Fort Wayne, Ind.

[21] Appl. No.: 603,789

[22] Filed: Aug. 11, 1975

[51] Int. Cl.[2] ..... B66F 11/04

[52] U.S. Cl. ..... 182/2; 212/144

[58] Field of Search ..... 182/2, 141, 148; 212/17, 10, 144; 214/1 H, 14

[56] References Cited

U.S. PATENT DOCUMENTS

| | | | |
|---|---|---|---|
| 3,064,754 | 11/1962 | Broderson | 182/2 |
| 3,085,648 | 4/1963 | Benedetto | 182/2 |
| 3,252,542 | 5/1966 | Trump | 182/2 |
| 3,844,378 | 10/1974 | Balogh | 182/2 |

*Primary Examiner*—Reinaldo P. Machado

*Attorney, Agent, or Firm*—John A. Young

[57] ABSTRACT

Transportable booms having lift platforms are now well established in the art. In the lift platform where the lift controls are located, there are means to operate an actuator and four bar linkage system in such manner that the lifting torque is substantially constant, and the arcuate or angular movement of the upper boom about its articulate connection on the lower boom is substantially constant, being at all times proportioned to the linear travel of the fluid motor actuator. In this way, the central purpose of the invention is achieved which is to obtain a controllable actuating system.

The four bar linkage system achieves optimum results when the driving link *a* is related to the follower link *b* driven link *c* and base link *d* in the proportion *a; b; c; d* = 1.52; 1.28; 1.00; 0.76 and the fixed pivot of the driving link is offset 0.27 units from the fixed pivot for the driven link.

5 Claims, 5 Drawing Figures

ACTUATING SYSTEM FOR TRANSPORTABLE ARTICULATED BOOMS HAVING RAISABLE PLATFORMS

BACKGROUND OF THE INVENTION

Transportable articulated boom constructions which are mounted in the back of trucks and have lift platforms referred to as "cherry pickers," and have become well established in the art. These type machines are useful in the maintenance and construction of utility lines, tree trimming, or for any other purpose in which the operator must be elevated and then positioned by means of control contained within a lift basket or lift platform. The described units are now well accepted in the art, but many of them are still subject to limitations, particularly in the respect that the control mechanism for raising, lowering and disposing the operator at the preferred three dimensional location is difficult to attain in a precise and predictable manner from the control mechanism because of the geometric changes which occur in the boom as it is raised, lowered, articulated and turned. The actuator system for the boom is supposed to be responsive to the control system in a predictable and proportioned manner, otherwise the operator cannot guide his movements from within the basket or platform.

In typical boom constructions, there is a lower boom and an articulated upper boom which is hinged to the lower boom; generally speaking there is a non-linear response of angular movement of the upper boom relative to the lower boom per linear displacement of the actuating system between the upper and lower booms. A good part of the problem is associated with the geometry of the system in that depending upon the angular position of the upper boom relative to the lower boom, a given linear displacement of the mechanical or fluid actuator will fail to yield a constant angular displacement output for the upper boom section. As a result, the operator finds it very difficult to control movements in any accurate manner because a given amount of actuation or movement called for by the control mechanism in the basket fails to yield a uniform resulting movement of the basket. This, of course, introduces an element of uncertainty and uncontrollability of the lift platform which can be undesirable since the operator is frequently called upon to make very precise movements relative to a service line, for example. Also, the torque output for the actuator tends to be non-uniform for the very reason that the degree of angular movement is non-proportional to the degree of movement of the actuator, and as a result, the system is non-uniformly stressed in the various starting and stopping positions of the upper boom relative to the lower boom.

For a combination of these reasons, the actuating and control systems, for the most part, have been untrustworthy and are generally objectionable because of non-linearity in response to the actuating mechanism to the control mechanisms.

OBJECTS OF THE INVENTION

The principal object of the present invention is to provide a linkage system to communicate the lifting force between a fluid motor actuator and the upper boom pivotably mounted on the end of a lower boom of a boom system so that regardless of the starting and ending angular positions of the upper boom relative to the lower boom, and regardless of the degree of actuation of the upper boom relative to the lower boom, there will be maintained a linear relationship between the angular displacement of the upper boom and the per unit actuating movement of the power cylinder actuator.

Another object of the present invention, is to provide a constant torque output between the fluid motor actuator and pivotable upper boom by which constancy of torque output is achieved through a four bar linkage which serves as the intermediate force transmitting system between the actuator and the pivotable upper boom.

Another object of the present invention is to provide a combination actuator and four bar linkage system which is disposed at the articulated connection between an upper and lower boom and is disposed within the lower boom so that the upper boom can be contracted into overlying relationship in which the two boom sections are resting one on top of the other substantially throughout their lengths. In this way, the two sections can be transported substantially more readily. The low profile of the cylinder and linkage within the confines of the lower boom reduces the likelihood of damage to the cylinder and reduces the incidence of damage to the linkage system.

Other objects and features of the present invention will be apparent from the following description:

DRAWINGS

Figure 2:
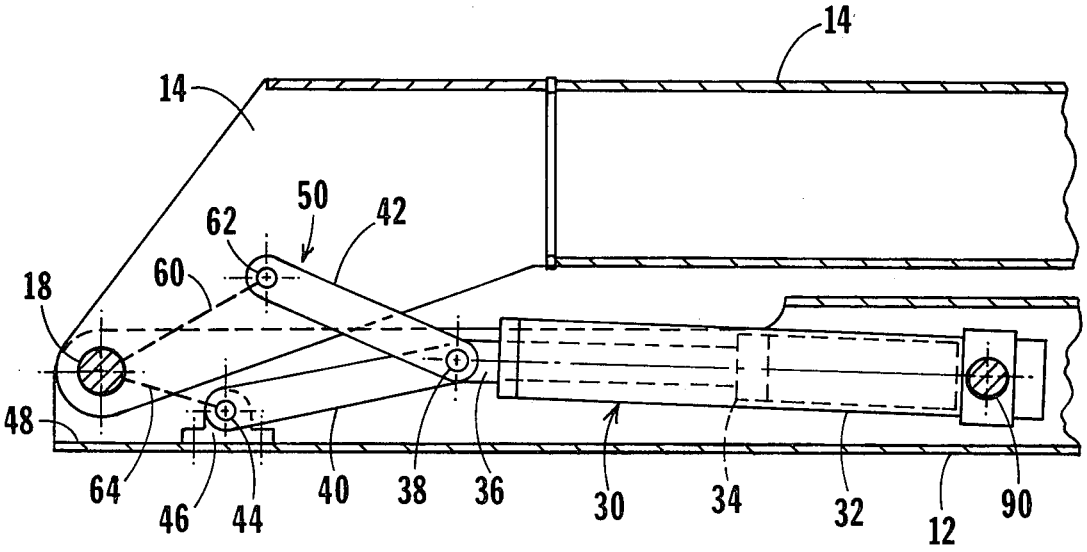
FIG. 2 is an enlarged sectional detail view of the actuator and linkage mechanism at the articulated section of the upper and lower boom, the boom actuator and linkage system being shown in their fully retracted position.
Figure 3:
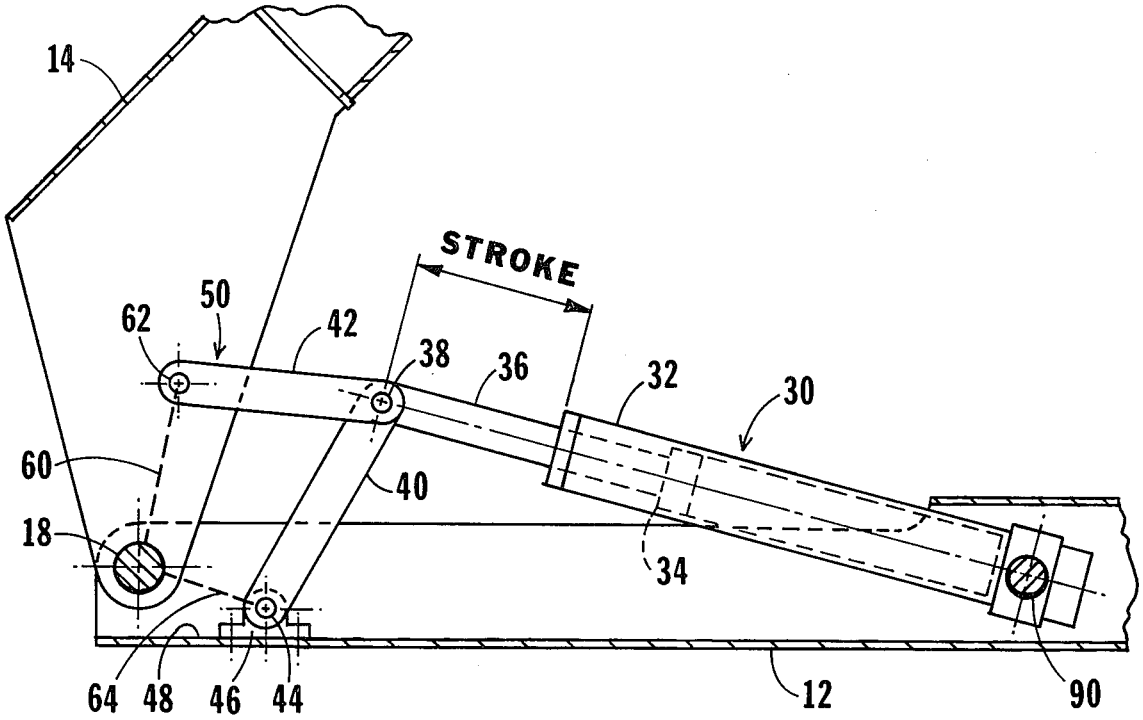
FIG. 3 is the same as FIG. 2, but illustrating the actuating mechanism and upper boom partially displaced from the stored or transferred condition FIG. 1 to a raise position of the upper boom relative to the lower boom.
Figure 4:
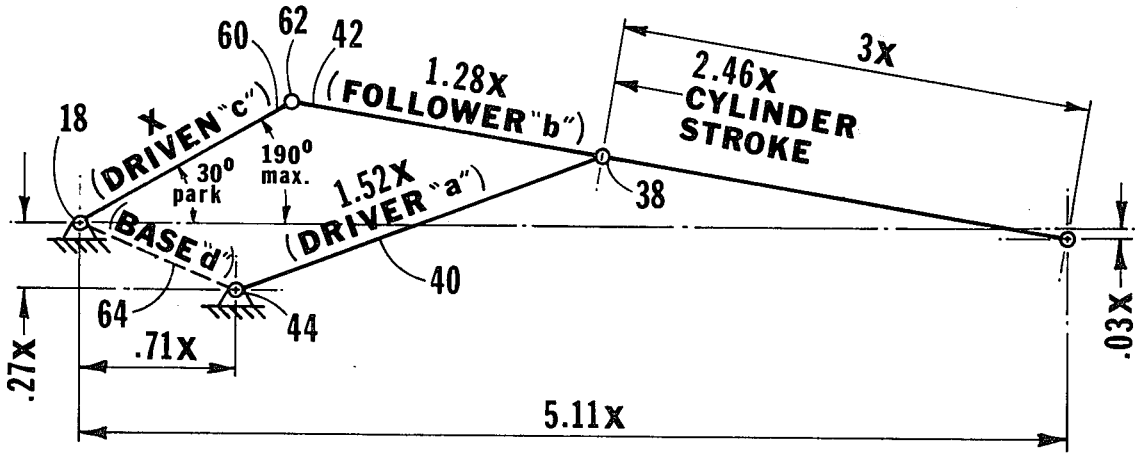
Figure 5:
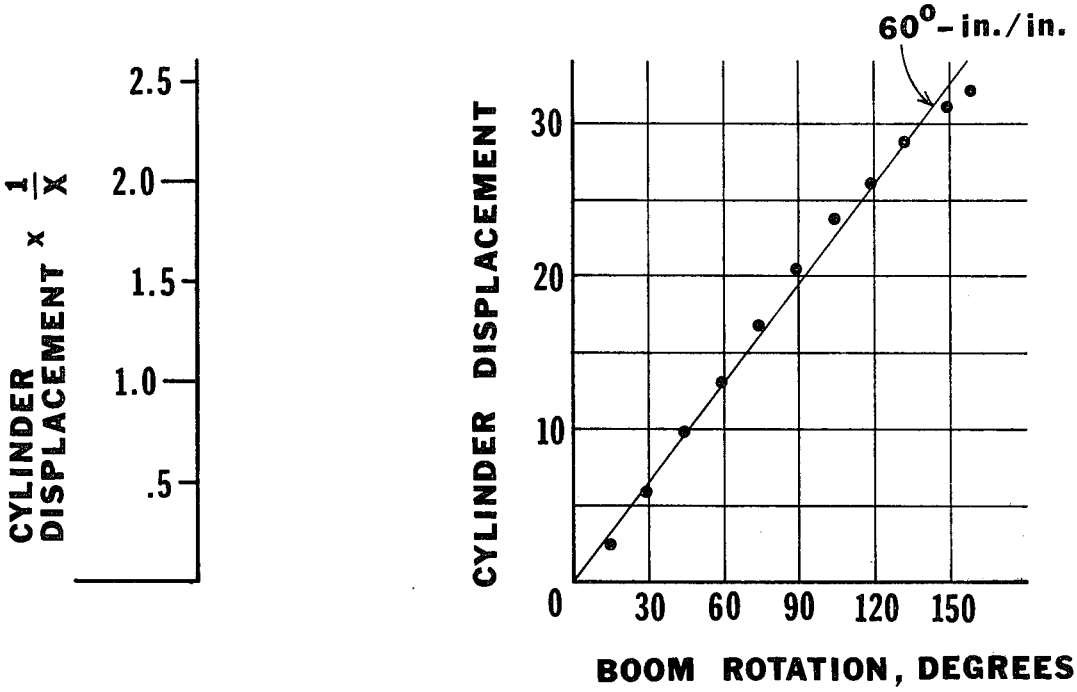

FIG. 4 is a four bar linkage system which is a mechanical counterpart of the linkage system illustrated in FIGS. 2 and 3 and which is shown in schematic form to better illustrate the relationship of the ratio of length and offset in order to achieve linearity of response by the linkage system; and FIG. 5 is a graph illustrating Boom Rotation In Degree versus Cylinder Displacement and illustrating the linearity of boom rotation response relative to cylinder displacement.

DETAILED DESCRIPTION OF THE INVENTION

Figure 1:
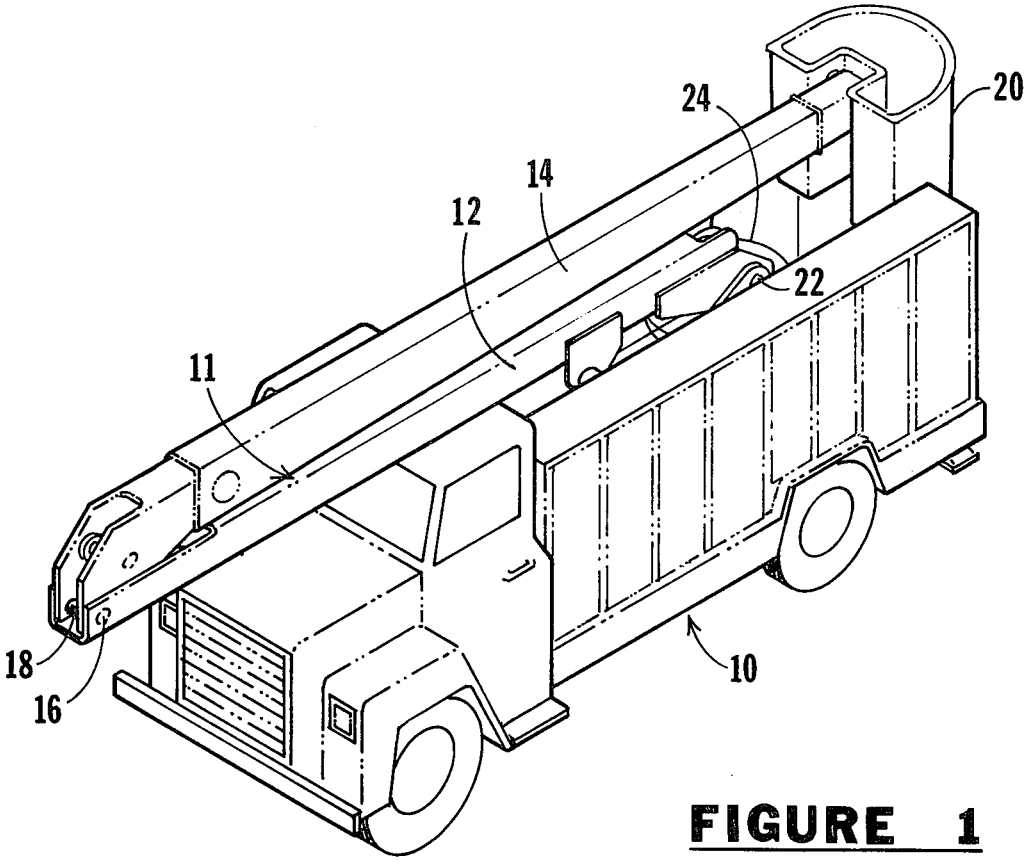
FIG. 1 is an isometric view of a truck and articulated boom having a raisable platform, both boom sections being controlled remotely from within the basket or platform.

Referring to FIG. 1, there is illustrated a vehicle 10 which is used to transport an articulated boom 11 consisting of lower 12 and upper 14 boom sections, these two parts being joined together at end 16 through an articulated connection 18. At the end of the upper boom 14 is a lift platform or basket 20 where an operator has controls available to him for effecting angular actuation of the lower boom 12 about a trunnion 22 supported on a turntable 24. The lower boom 12 is both pivoted on 22 and is rotatable on a vertical axis through turntable 24.

The lower boom 12 can rotate 360° on a vertical axis and can swing in a vertical plane about trunnion 22 through approximately 120°–130°.

The upper boom 14 can rotate angularly on its articulated connection 18 with the lower boom 12 through approximately 80°. By a combination of these angular and rotational movements the operator can achieve a displacement or "excursion" (as it is sometimes referred to) so that the operator is capable of a wide range of three dimensional movements, horizontally, laterally and vertically, from a given location where the transport truck 10 comes to a stop.

Thus far, the construction is conventional and well established.

The defect of the prior practice is that the upper boom 14 is not readily displaceable in a proportional manner relative to the lower boom on its articulating connection 18, such that for each increment of movement of the actuator, responsively to the control, there is a variable response of angular displacement, depending upon the position of the upper boom 14 relative to the lower boom 12.

The present invention achieves linearity of angular displacement and constancy of torque output through operation of a fluid motor actuator 30 (FIGS. 2, 3) consisting of a cylinder 32 double acting piston 34 slidably mounted within the cylinder, and having a piston rod 36 acting through a four bar linkage designated generally by reference number 50. The piston rod 36 has a pivot pin connection 38 with a driver link 40 and a follower link 42. Fixed pivot 44 for the driver link 40 is secured through trunnion 46 to the inner surface 48 of the boom 12 in such manner that the linkage, as well as the actuator 30 is received within the lower boom and is thereby protected. Also, the arrangement is such that full retraction of the upper boom 14 relative to lower boom 12 is permitted, allowing these two boom sections to lie one over the other in a fully contracted position, thereby making transport more convenient and locating the basket 20 lowered to the maximum extent.

(FIGS. 2, 3, 4) To complete the linkage description, in addition to the driver linkage 40 and follower linkage 42, there is driven linkage 60 and, constituted by that portion of the upper boom 14 between pivot 62 and fixed pivot 18.

The base linkage 64 is constituted by that portion of the lower boom 12 which is between pivot 18 and fixed pivot 44.

The mechanical analogue of the four bar linkage (FIG. 2) is shown in FIG. 4, in which the driver linkage 40 *a*, the follower linkage 42 *b*, the driven linkage 60 *c* and base linkage 64 *d* are related to each other such that $a: b: c: d = 1.52: 1.28: 1.00: 0.76$ the displacement between a horizontal line through fixed pivot 18 to the pivot 44 is 0.27 and the lateral displacement from fixed pivot 18 to fixed pivot 44 to 0.712.

The characteristics of the four bar linkage are such that rotation of the boom in degrees, is substantially constantly linearly related to cylinder displacement in the manner indicated by FIG. 5.

Thus, when the operator within the lift platform 20 actuates the mechanism to effect angular movement of upper boom 14 about 18, linear movement of piston 34 will produce, in each instance, regardless of the angular position of boom 14, a degree of rotation of the boom 14 which is at all times linearly related to the displacement of the piston, in accordance with the relationship shown in FIG. 5. Additionally, the load carrying capacity at extreme end (basket end) of the boom 14 is optimized in that there is a constant torque output between the actuator 32 and the torque requirements at the operator or basket end 20 of the boom 14.

It is an important feature of the present invention that it is possible, given any boom length, to provide a linkage 50 having the proportionality previously described and which will render the relationship of angular boom rotation to piston displacement for that given boom configuration.

At the beginning of operation the driven link 60, when the boom is fully retracted, is at an approximately 30° angle and is rotatable through approximately 190° maximum angle to effect boom 14 rotation to its maximum extent, i.e., about 78°–80° relatively to the pivot 18.

OPERATION

In operation, the operator of the truck is transported to the point of approximate use; thereafter, an operator within the basket or lift platform 20 by means of a hydraulic actuator control (not shown) effects a combination of rotation of boom 12 about trunnion 22, counterrotation of upper boom 14 about trunnion or axle 18 and circular movement of the entire boom about a vertical axis on turntable 24.

The present invention is concerned primarily with the operation of the upper boom 14 about axle or articulated linkage 18 which is accomplished by power cylinder 32. Because the actuator 32 is located at the elbow or articulated connection of the boom sections, it is advantageously disposed compared to other actuating mechanisms, which are not so located. In the present invention, this advantage is enhanced by employing a four linkage system consisting of driver link 40, follower link 42, driven link 60 constituted by a portion of the upper boom, and a base link 64 constituted by the lower boom 12.

Schematically, the link system is indicated in FIG. 4 and operates, by communicating driving force from power cylinder 32 to floating pivot 38 causing rotation of drive link 40 about 44 and causing the follower link 42 to communicate lifting force through 62 to the upper boom 14. The upper boom 14 has a portion which constitutes driven link 60, causing rotation of the upper boom about 18. The distance between fixed pivot 18 and fixed pivot 44 constitutes the base link 64. There is a combination then of three fixed pivots 18, 44 and 90, 90 being the pivot for the cylinder 32, and two floating pivots 38 and 62.

The characteristic of the four bar linkage is that linear movement of the piston is connected to angular boom rotation in degrees, in accordance with the graph illustrated in FIG. 5. Cylinder displacement effects a constantly proportionally boom rotation and as a result, the operator has a greater degree of control of the angular movement of the upper boom 14. Also, there is optimized the load carrying capacity at the extreme end of the excursion for the basket 20. That is, upper boom movements are at all times proportional to the degree of actuation of the power cylinder 32 and the control mechanism used by the operator. As a result the system is subject to accurate and precise basket placement by the operator.

When the linkage is fully retracted as shown in FIG. 2, the upper boom 14 fully collapses on boom 12 and the basket 20 is in its lowermost position for transport. Because the two booms collapse to such an extent, they are more conveniently transported and the actuator linkage system is nested between the sides of the lower boom and between the upper and lower boom to protect the actuator system against injury.

Calculating from fully retracted to maximum excursion, the driven link 60 commences at 30° position (FIG. 4) and is operable through 190° maximum excursion. The cylinder stroke consists of approximately 2.46 times the length of the driven link 60 and as the cylinder moves, it operates through an angle such that the vertical offset is 0.288 $x$ (FIG. 4).

The low profile of the cylinder and its protected position within the lower boom reduces the occurence of damage in the aforesaid manner, both in retraction position and while the upper boom 14 is rotated out of retracted position to effect vertical lift of the basket 20.

Although the present invention has been illustrated and described in connection with a single example embodiment, it will be understood that this embodiment is illustrative of the invention and is by no means restrictive thereof. For example, the proportionality of the links can be varied to suit boom length and can be varied to achieve maximum advantage so far as linearity of boom rotation/cylinder displacement is concerned and also in order that there can be proportionality so far as torque is provided on the upper boom 14 relative to the output of the power cylinder.

Other features and advantages of the invention will occur to those skilled in the art and it is intended that these revisions and adaptations will be included within the scope of the following claims as equivalents of the invention.

What is claimed is:

1. In a vehicle, an operator controlled elevatable platform and a lift boom consisting of an upper boom and a lower boom having a mounting providing operatively selectable movement on a vertical axis, said platform being disposed at the projected end of said upper boom, means for elevating the lower boom by arcuate displacement in a vertical plane about the pivoted end thereof, and actuator means disposed between said upper and lower booms at the articulated connection therebetween and comprising a fluid motor actuator, including a cylinder having an intermediate trunnion mounting disposed at the geometric center of one of said booms, and a four bar linkage force-transmitting connection comprising a base link a driver link, a driven link and a follower link, between said fluid motor actuator and said boom and effective at full contraction of said booms relatively to each other wherein said upper boom is in surmounted parallel relation to the lower boom and wherein said fluid motor actuator is fully retracted into its associated boom, the respective bars of said four bar linkage being arranged in which the active forces on each bar of said bar linkages are limited to tension and compression and at least one of said bars is disposed wholly within the associated boom when said fluid motor actuator is fully retracted, said four bar linkage having three pivot connections with said upper and lower booms respectively and so disposed that a line connecting said trunnion mounting and the connection of said fluid motor actuator with said four bar linkage is geometrically offset relatively to the pivoted end of said upper boom and disposed to impart lift force to said upper boom commencing from full retraction of said upper and lower booms.

2. The construction in accordance with claim 1 wherein said linkage system comprises a four bar linkage in which the base is provided by the lower boom, driver link operatively connected to said actuator means, a driven link constituted by a part of the upper boom and pivotly connected to the lower boom and a follower link pivotably connects the ends of said driver and driven links remotely from their pivot connections with said lower boom.

3. The construction in accordance with claim 1 in which said four bar linkage is constructed with the respective bars in a relative proportion effecting substantially uniform angular movement of the upper boom per unit displacement effected by said hydraulic actuator.

4. The construction in accordance with claim 3 in which the drive link $a$ follower link $b$ driven link $c$ and base link $d$ are in the relative proportion of 1.52; 1.28; 1.0 and 0.76 and the pivot point of the driver link $a$ is 0.27 units below a horizontal line through the pivot point for the driven link.

5. The construction in accordance with claim 1, in which said piston and linkage system are proportioned to lie substantially entirely within the lower boom section whereby the upper boom section and lower boom section are transportable in overlying relation.

* * * * *